US005248223A

United States Patent [19]

Hill

[11] Patent Number: 5,248,223

[45] Date of Patent: Sep. 28, 1993

[54] FUEL PUMP WITH ANTI-REVERSION INLET

[75] Inventor: Gerald A. Hill, Caro, Mich.

[73] Assignee: Walbro Corporation, Cass City, Mich.

[21] Appl. No.: 895,912

[22] Filed: Jun. 9, 1992

[51] Int. Cl.[5] ..... F04D 29/48

[52] U.S. Cl. ..... 415/55.3; 415/55.4; 415/55.2; 415/173.1; 417/423.3; 417/369

[58] Field of Search ..... 415/55.1, 55.2, 55.3, 415/55.4, 173.1; 417/423.3, 369

[56] References Cited

U.S. PATENT DOCUMENTS

| | | | |
|---|---|---|---|
| 3,272,137 | 9/1966 | Maitlen et al. | 415/173.1 |
| 3,324,799 | 6/1967 | Terrano | 415/55.4 |
| 3,545,890 | 12/1970 | Hubbard et al. | 415/55.3 |
| 3,926,281 | 12/1975 | Hannibal | 417/372 |
| 4,205,947 | 6/1980 | Ruhl et al. | 417/205 |
| 4,279,570 | 7/1981 | Egli et al. | 415/55.4 |
| 4,336,002 | 6/1982 | Rose et al. | 417/205 |
| 5,129,796 | 7/1992 | Emmert et al. | 417/423.3 |
| 5,149,252 | 9/1992 | Tuckey et al. | 415/55.6 |

*Primary Examiner*—Edward K. Look
*Assistant Examiner*—Mark Sgantzos
*Attorney, Agent, or Firm*—Barnes, Kisselle, Raisch, Choate, Whittemore & Hulbert

[57] ABSTRACT

A centrifugal fuel pump with a baffle disposed between a fuel inlet and an impeller of the pump. The baffle overlies the inlet opening and substantially prevents the impeller from producing a backflow of fuel through the inlet. The baffle also directs incoming fuel into a generally circumferential flow into the channel of the pump through which fuel is moved and its pressure increased by the rotating impeller. This improves the efficiency and maximum capacity of the pump.

12 Claims, 3 Drawing Sheets

FUEL PUMP WITH ANTI-REVERSION INLET

FIELD OF THE INVENTION

The present invention is related to fuel pumps for internal combustion engines and more particularly to a centrifugal fuel pump with fuel inlet baffling improving efficiency.

BACKGROUND OF THE INVENTION

Electrically driven self-contained in-tank rotary fuel pumps have been used for delivering gasoline from a supply tank to an internal combustion engine of a motor vehicle. This type of pump produces a steady, non-surging, highly pressurized flow of fuel making it ideal for use with modern fuel injection systems. The design is also highly tolerant of fuel supply line pressure transients commonly associated with the abrupt opening and closing of individual fuel injectors.

Typically, these pumps consist of a housing having a fuel inlet cover on one end and an outlet cover at the opposite end. Inside the housing, at least one and sometimes two rotors for imparting motion and momentum to the fuel are mounted on a drive shaft of an armature of an electric motor. In a common design, an intake rotor having a plurality of circumferentially spaced radial impeller vanes and cavities is located adjacent the inlet for drawing fuel from the tank. During operation, fuel through an inlet passage of the inlet cover is suctioned into the impeller cavities and propelled circumferentially in the direction of rotor rotation. A second rotor receives fuel from the first impeller and forcibly expels it from the pump to the engine.

However, during operation, as each cavity of the intake rotor passes over the inlet, centrifugal force acting on fuel within the cavity displaces some of the fuel back into the inlet causing turbulence to and vaporization of the incoming fuel, reducing the amount of fuel entering the pump and decreasing pump flow rate and efficiency while increasing the electrical energy demand of the motor.

SUMMARY OF THE INVENTION

A pump with a channel, impeller and a baffle plate disposed between them and over an inlet passage to direct entering fuel into the channel and virtually eliminate backflow of fuel into the inlet passage. This promotes laminar flow within the inlet passage, improves pump throughput, reduces the required pumping energy and increases efficiency. The baffle may be integrally formed as part of the fuel inlet of the pump or may be a separable plate adjacent the inlet. Preferably the baffle has a pair of concentric, flat rings interconnected by a web or plate.

It is an object of the present invention to increase pumping capacity of a centrifugal fuel pump by baffling incoming fuel laterally and virtually prevent backflow of fuel into the inlet passage. It is also an object to promote laminar flow of the entering fuel to reduce the amount of energy required to pump the fuel. It is a further object to increase fuel flow while decreasing pumping energy required resulting in an increase in pump efficiency. Finally it is an object of this invention to provide a baffle for directing fuel flow which is resilient and durable, impervious to fuel, has a smooth laminar flow promoting surface, and is of economical manufacture and of good quality construction.

These and other objects, features and advantages of this invention will be apparent from the following detailed description, appended claims and accompanying drawings in which details of the invention are set forth to enable those skilled in the art to practice the invention, all in connection with the best mode presently contemplated for the invention.

DETAILED DESCRIPTION OF THE INVENTION

Figure 1:
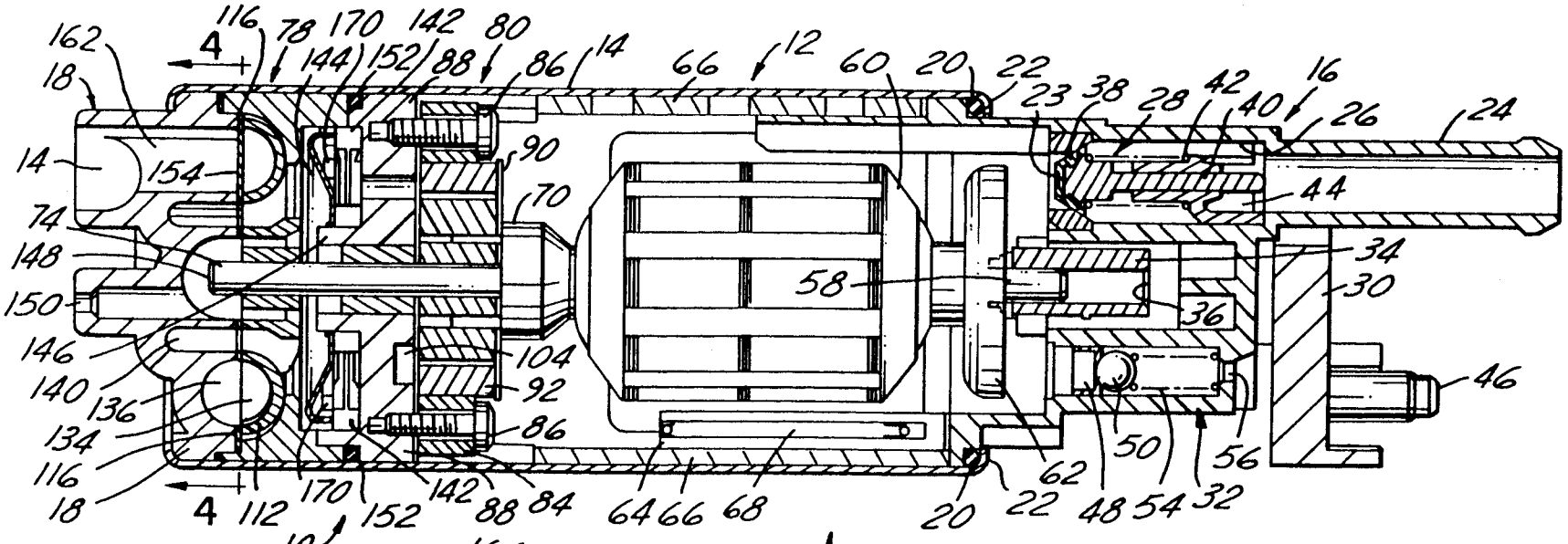
FIG. 1, is a longitudinal sectional view of an assembled two stage rotary pump embodying the present invention.

FIG. 1 illustrates a fuel pump 8 with a two stage pump assembly 10 and a motor assembly 12 enclosed by a generally tubular central housing 14, with a cylindrical outlet cover 16 at one end and a cylindrical inlet cover 18 at the opposite end. One end of the central housing 14 is turned radially inwardly around an 0-ring 20 and a flange 22 of the outlet cover 16 to sealingly receive and support the outlet cover. The opposite end of the central housing 14 is turned radially inwardly to sealingly receive and support the inlet cover 18.

The outlet cover 16 is of unitary construction and has an outlet tube 24 communicating with the interior of the housing through a bore 26 with a spring-biased check valve 28 received in the bore 26. An electrical terminal bracket 30 is attached to the cover and has terminals 46 for supplying electric current to the motor. A pressure relief valve 32 is received in the cover and an armature bushing 34 is received in a recess 36 in the cover.

The check valve 28 has a seat 38 for receiving a long-stemmed valve element 40 biased onto the seat by a spring 42 and slidably received in a housing 44 disposed in the bore 26. During pump operation, pressurized fuel from inlet orifice 23 urges the valve element 40 to open enabling the fuel to pass through the outlet tube 24 and into an attached fuel supply line. When the pump is not operating or when pressure in the fuel supply line becomes too great, the spring 42 and the pressure of fuel in the line firmly seats the valve 40 preventing backflow into the pump while maintaining line pressure. The pressure relief valve 32 has a seat 48, a ball 50 yieldably biased onto the seat by a spring 54 and a port 56 leading to the exterior of the pump. Should the pressure of fuel within the pump exceed the biasing force on the ball 50, it will be unseated enabling one-way passage of fuel out the port 56.

A shaft 58 of an armature 60 of the motor assembly 12 is rotatably supported within the bushing 34. Surrounding the shaft 58 is a commutator plate 62 for delivering electricity from brushes to the armature 60. A pair of arcuate magnets 64 are retained in place against a cylindrical flux tube 66 by spring clips 68. Mounted on the other end of the armature is a drive dog 70 having a plurality of circumferentially spaced cylindrical fingers 72 and an elongate drive shaft 74 with flattened faces 76.

A first stage turbine pump 78 and a second stage gear rotor pump 80 are both driven by the motor 12. The gear rotor pump has a chamber 82 defined by a cam ring 84 secured by Torx-head screws 86 to a cover plate 88 and a sealing disc 90 bearing on the other side of the cam ring. A gear rotor 92 enmeshed with a complementary outer gear ring 94 are received in the chamber and drivingly coupled to the motor by the fingers 72 of the dog 70 which extend through clearance holes 96 in the disc 90 and are received in holes 98 in the gear rotor 92. The rotor is piloted or journalled on the shaft 74 which extends through a hole 100 in the cover plate 88.

The cam ring 84 is mounted eccentrically to the axis of rotation of the gear rotor 92 which has a different number of teeth than the number of recesses between the teeth of the gear ring 94. For example, the gear rotor 92 may have ten teeth and the ring 94 eleven recesses. Thus, as the rotor 92 turns, the gear ring 94 also rotates in the cam ring 84 which increases the pressure of the fuel received between them.

The cover plate 88 has a through-opening inlet 102 and an arcuate outlet channel 104 with openings 106 extending through the outer peripheral edge of the plate 88. Fuel entering the chamber through the inlet 102 is received within a plurality of cavities 108 between the rotor 92 and the ring 94. As the motor 12 turns the rotor 92 and ring 94, fuel within each cavity 108 is transported circumferentially, compressed as cavity volume is decreased and expelled into the outlet channel 104. Traveling along the outlet channel 104, the fuel exits the cover plate 88 through openings 106, passes around the armature 60 and exits through the pump outlet 24. The construction, arrangement and operation of a suitable gear rotor pump is described in detail in U.S. Pat. No. 4,500,270, the disclosure of which is incorporated herein by reference and hence will not be described in further detail.

The first stage pump 78 has an impeller or rotor 112, an inlet passage 114 through the inlet cover 18 and a baffle plate 116 disposed between them. The impeller 112 has a hub 118 with a slot 120 for drivingly receiving the flattened end 76 of the drive shaft 74. Four spokes 122 extend from the hub 118 to an inner peripheral edge of a hemi-toroidal rotor with an annular wall 124 having a generally U or semi-circular shaped cross section. The impeller has a plurality of impeller blades 132 extending generally radially radiating from the inner peripheral edge to the outer peripheral edge of the wall 124 and defining a plurality of cavities 134 between the blades 132. Vapor return passages 128 and fuel outlet passages 130 are defined by the cooperation of a generally cylindrical wall 126 which interconnects with each spoke 122 and is spaced between the hub and the impeller surface 124. These are circumferentially spaced arcuate passages extending radially through the rotor 112.

The interior of the inlet cover 18 has an outer annular channel 136 which extends circumferentially from the inlet passage 114 to a ramp portion 138 which communicates with a concentric inner circumferential outlet channel 140 which, in assembly, communicates with the outlet passages 130 through the impeller. Preferably, in cross section the outer channel has a U or semi-circular shape. In assembly, the outer channel is generally axially aligned with and underlies the toroidal wall 124, blades 132 and cavities 134 of the impeller for cooperation therewith. To join the outer channel 136 with the inner channel 140, the ramp is inclined and spirals inwardly.

In conjunction with the cover plate 88, a spacer ring 110 defines a cavity in which a filter screen 142 and a frusto-conical vapor separating baffle plate 144 are received with the baffle press fit over a central hub 146 of the cover plate 88. Vaporized fuel discharged by the first stage is bled from the pump through a central recess 148 in the inlet cover 18 which communicates with the passages 128 in the impeller, and a vent 150 in the bottom of the recess 148 which opens to the exterior of the cover 18 and is offset from the axis of the cover 18. A seal is provided between the cover plate and the spacer frame by an O-ring 152 disposed between them and received in a groove in the cover.

Figure 4:
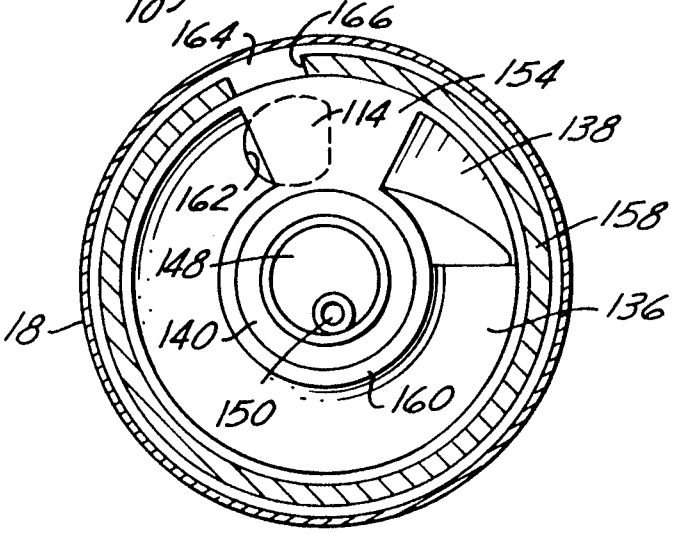
FIG. 4, is an elevational view of the inlet cap with a baffle plate embodiment overlying the inlet port.
Figure 2:
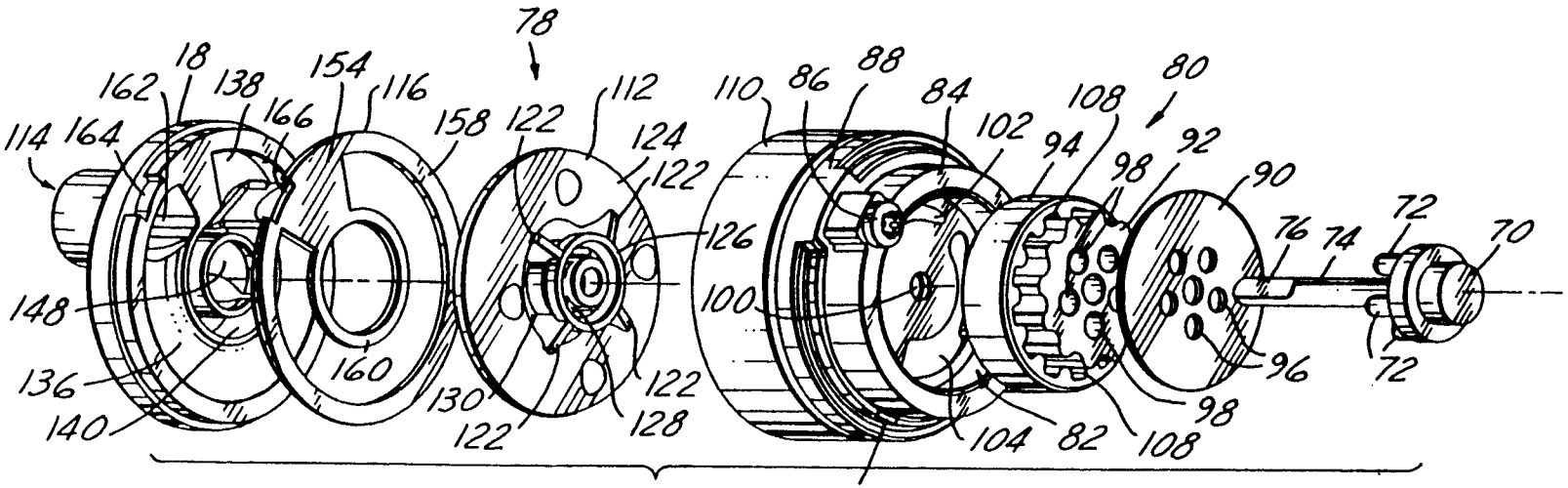
FIG. 2, is an exploded perspective aft view of the rotary pump assembly.
Figure 3:
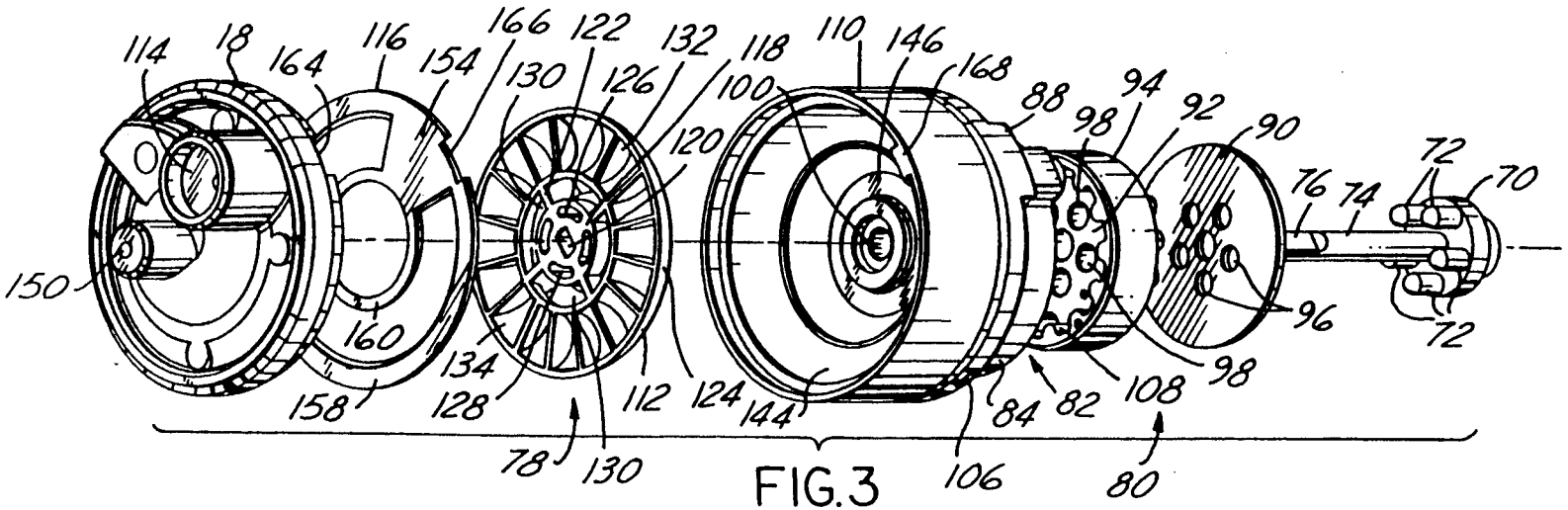
FIG. 3, is an exploded perspective fore view of the rotary pump assembly.

In accordance with one feature of this invention, the back flow of fuel from the rotating impeller into the inlet is substantially eliminated and fuel flowing through the inlet is directed from a generally axial to a generally circumferential direction of flow by a generally rectangular or trapezoidal shaped plate 154 of the baffle 116 which overlies the inlet 114 and is disposed between the inlet 114 and the impeller 112. The plate 154 is flat and interconnects an outer flat band or ring 158 and a concentric inner flat band or ring 160 of the baffle 116. The plate 154 is axially spaced from an opening 162 of the inlet 114 into the outer channel 136 so that fuel can flow into the channel. Preferably, as shown in FIG. 4, the plate 154 extends radially and circumferentially to overlie at least substantially the entire circumferential and radial extent of the opening 162. Thus, the plate 154 is at least substantially coextensive with the opening 162 of the inlet 114 into the channel 136.

The outer band 158 provides a seal between the outer peripheral wall of the outer channel 136 and the outer peripheral edge of the rotor surface 124 for preventing leakage during pump operation. The inner band 160 provides a seal between the inner peripheral wall of the channel 136 and the inner peripheral edge of the rotor 124. During assembly, slots 164, 166 in both the inlet cover 18 and baffle plate 116 engage with a corresponding tab 168 on the spacer ring 110 to properly position the inlet cover 18 and locate the trapezoidal plate 154 of the baffle 116 over the inlet 114. The baffle plate 116 is preferably has laminar flow-promoting smooth surfaces and is made of metal such as steel, stainless steel or aluminum or a plastic composition which is impervious to fuel such as a thermoset phenolic resin.

Figure 5:
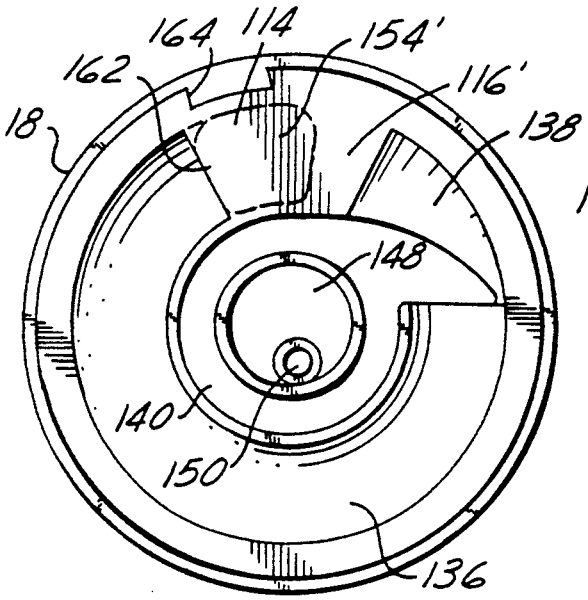
FIG. 5, is an elevational view of a second embodiment of a baffle plate integrally molded with the inlet cap.
Figure 6:
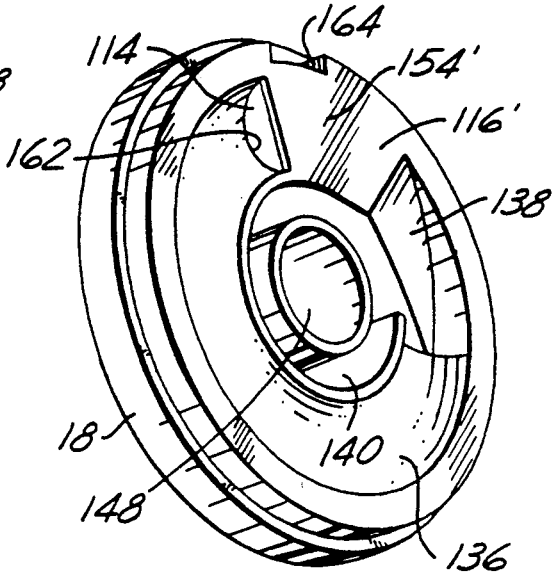
FIG. 6, is a perspective view of the inlet cap of FIG. 5.

Alternatively, the baffle can be an integral part of the inlet cover. As shown in FIGS. 5 and 6, the baffle 116' may be formed integrally with the inlet cover 18 as a plate 154' over the inlet passage 114 (shown in phantom) such as by molding them together in a one piece body of a plastic material.

In operation, the electric motor 12 imparts rotary motion to the impeller 112 creating a vacuum in the region of the inlet 114 which draws fuel into the pump 10. Ordinarily, some fluid within each cavity 134 of the moving impeller 112 would be centrifugally propelled outward into the inlet passage 114 as each cavity 134 passes over the inlet 114 which would create turbulence and vaporization of fuel within the passage 114 and decrease pump performance. However, with the addition of the baffle 116 or 116' over the inlet 114, backflow into the inlet 114 is substantially prevented because fuel cannot be discharged from a rotor cavity 134 when it is directly over the baffle plate 154 or 154' overlying the inlet 114. Incoming fuel flowing through the inlet 114 is directed laterally or circumferentially into the channel 136 and drawn into a rotor cavity 134 only after it is beyond the inlet 114. After passing by the baffle plate 154 or 154', the fuel is moved through the channel 136 by rotation of the rotor 112 until it reaches the ramped portion 138. Upon reaching the ramp 138, the fuel passes into the inner channel 140 from which it flows through the outer arcuate passages 130 of the rotor 112 and into the region of the vapor baffle plate 144. Fuel impinging upon the vapor baffle 144 is separated into liquid and vapor components. The vapor is returned through the inner arcuate passages 128 of the rotor 112 and vented through the vapor exhaust vent 150 to prevent pump cavitation and minimize turbulence. The remaining liquid fuel is propelled through a plurality of openings 170 in the outer periphery of the vapor baffle 144, through the filter screen 142, and into the inlet 102 of the cover plate 88 where it is received by the second stage gear rotor pump 80.

The fuel is moved through the pump chamber 82 by the turning gear rotor 92 and follower ring 94 and is discharged through the openings 106 of the outlet 104 into the housing 14. The fuel flows over the motor armature 60 through the check valve 28 and is discharged from the pump 8 through the outlet 24. If the fuel pressure exceeds a predetermined value it is bled from the housing 14 through a pressure relief valve 32 to the exterior of the pump which in use is usually received in a fuel tank of a vehicle.

As only two preferred embodiments have been disclosed, it will be understood that there may be modifications, variations, changes in and other embodiments of the invention which fall within the spirit, scope and fair meaning of the following claims.

What is claimed is:

1. A fuel pump comprising, a housing, an annular channel in said housing, a fuel inlet in said housing and opening into said annular channel for communicating therewith, an outlet communicating with said annular channel at a location generally circumferentially spaced from and downstream of said inlet, an impeller having an annular channel with a plurality of generally radially extending and circumferentially spaced apart blades therein defining a plurality of circumferentially spaced cavities between said blades which are generally opposed to and open toward said annular channel in said housing, and a baffle plate overlying said opening of said inlet into said annular channel and disposed between said impeller and said annular channel in said housing and extending generally circumferentially and radially sufficiently to overlie substantially the entire generally radial and circumferential extent of said opening of said inlet into said annular channel in said housing so that when said impeller is rotating to move fuel through said outlet said baffle substantially prevents the discharge of fuel from said cavities into said inlet as said cavities are swept over said baffle plate by rotation of said impeller.

2. The fuel pump of claim 1 wherein said housing comprises a tube and a generally circular cover adjacent one end of said tube, said annular channel in said housing extending generally circumferentially in said cover and opening toward a side face thereof, said inlet extending generally axially from the exterior of said cover and opening into said annular channel in said housing adjacent one end of such annular channel, said outlet comprising a generally annular groove in said cover disposed radially inwardly of said annular channel in said housing and opening toward said one side face of said cover, said annular groove communicating with said annular channel in said housing adjacent the other end of such annular channel.

3. The fuel pump of claim 2 wherein said baffle plate is axially spaced from the opening of said inlet into said annular channel in said housing.

4. The fuel pump of claim 3 wherein said baffle plate is homogenously integral with and part of said cover.

5. The fuel pump of claim 3 wherein said baffle plate is homogenously integral with and a part of said cover and they are molded in one piece of a plastic material which is substantially impervious to hydrocarbon liquid fuel.

6. The fuel pump of claim 5 wherein said plastic material is a thermoset plastic.

7. The fuel pump of claim 5 wherein said plastic material is a phenolic resin.

8. The fuel pump of claim 3 wherein said baffle plate is of metal.

9. The fuel pump of claim 2 which also comprises a separate disc of substantially uniform thickness and having a first annular band, a second annular band concentric with, encircling, and having a larger diameter than said first annular band, and a web interconnecting said first and second bands, said disc being disposed between said cover and said impeller with said first band providing a seal between the radially inner peripheral edges of said annular channels in said cover and impeller, said second band providing a seal between the radially outer peripheral edges of said annular channels in said cover and impeller, and said web providing said baffle plate disposed over said opening of said inlet into said annular channel in the cover.

10. The fuel pump of claim 9 wherein said disc is made of a plastic material impervious to hydrocarbon liquid fuel.

11. The fuel pump of claim 10 wherein said disc is made of metal.

12. The fuel pump of claim 3 wherein said baffle plate comprises a generally flat plate pressed into said cover and extending generally circumferentially and radially sufficiently to overlie substantially the entire generally radial and circumferential extent of the opening of said inlet into said annular channel in said housing.

* * * * *